US008960094B1

(12) United States Patent
Calvert

(10) Patent No.: US 8,960,094 B1
(45) Date of Patent: Feb. 24, 2015

(54) BULLET WITH PUSH-OUT EXPLOSIVE

(71) Applicant: BPOE Associates, Trustee for Bullet push-out explosive CRT Trust, Manassas, VA (US)

(72) Inventor: S. Mill Calvert, Manassas, VA (US)

(73) Assignee: BPOE Associates, Trustee for Bullet push-out explosive CRT Trust, Manassas, VA (US)

( * ) Notice: Subject to any disclaimer, the term of this patent is extended or adjusted under 35 U.S.C. 154(b) by 0 days.

(21) Appl. No.: 14/250,657

(22) Filed: Apr. 11, 2014

Related U.S. Application Data

(63) Continuation-in-part of application No. 14/057,417, filed on Oct. 18, 2013, now Pat. No. 8,783,184.

(51) Int. Cl.
*F42B 5/02* (2006.01)

(52) U.S. Cl.
USPC ..... 102/434; 102/371; 102/439; 102/478; 102/517; 102/501

(58) Field of Classification Search
CPC ..... F42B 12/00; F42B 30/00; F42B 5/02
USPC ..... 102/434, 371, 439, 478, 517, 501
See application file for complete search history.

(56) References Cited

U.S. PATENT DOCUMENTS

| | | | | |
|---|---|---|---|---|
| 2,446,082 | A | 7/1948 | Dixon | |
| 2,475,632 | A | 7/1949 | Moore et al. | |
| 2,532,323 | A | 12/1950 | Miller, Jr. | |
| 3,302,570 | A | 2/1967 | Marquardt et al. | |
| 4,353,302 | A | 10/1982 | Strandli et al. | |
| 4,384,528 | A | 5/1983 | Moore et al. | |
| 4,574,702 | A | 3/1986 | Brandt | |
| 4,625,650 | A | 12/1986 | Bilsbury | |
| 4,887,534 | A | 12/1989 | Dickovich et al. | |
| 5,728,968 | A | 3/1998 | Buzzett et al. | |
| 8,720,342 | B1 * | 5/2014 | Gold et al. | 102/495 |
| 2011/0023743 | A1 * | 2/2011 | Heitmann | 102/476 |

OTHER PUBLICATIONS

Sage Control Ordinance Inc., Model BP45, 40MM Baricade Penetrating Projectile, specifications, published online at http: // www. sageinternationalltd.com/SCOI/specs/SCOI_SpecSheet_BP45. pdf, downloaded Oct. 10, 2013.

* cited by examiner

*Primary Examiner* — J. Woodrow Eldred
(74) *Attorney, Agent, or Firm* — Louis Ventre, Jr.

(57) ABSTRACT

A bullet defines a chamber and mechanism for extending an explosive body from the chamber. The chamber has a broader top portion than a lower portion. The bullet further defines a channel passage leading out of the top end of the bullet. The bullet contains the explosive body slidably engaged within the channel passage. A shaft is connected to the body and passes down from the body into the lower portion of the chamber. A thrust plate is connected to the shaft end in the chamber. The thrust plate is spring metal and when the cartridge is fired, the thrust plate rises pushing the body so that it extends from the leading end of the bullet. When the thrust plate rises to the second portion of the chamber, it springs open to prevent subsequent downward motion of the thrust plate and consequently prevents subsequent retraction of the body during flight.

3 Claims, 3 Drawing Sheets

BULLET WITH PUSH-OUT EXPLOSIVE

CROSS-REFERENCE TO RELATED APPLICATIONS

This application is a continuation-in-part of application Ser. No. 14/057,417, filed 18 Oct. 2013, which is hereby incorporated by reference herein.

TECHNICAL FIELD

In the field of ammunition and explosives, a bullet with an extensible explosive charge that increases lethality and bullet penetration where the bullet is a part of a cartridge for a firearm.

BACKGROUND ART

In today's military world of explosive ordnance, the state of the art technology is to be able to have an initial explosive charge mechanism that will first explode upon impact to start to make an opening before the primary explosive charge goes off. This may be followed by the solid bullet body or a second explosive charge. The state of the art applies primarily to large cannon artillery shells and very little of such technology applies to firearm cartridges.

A pre-explosive charge which may be followed by a larger explosion enable ordnance to penetrate farther and deeper into an armored target. Even though this first and second stage explosive ordinance works well, the military has few options to choose from in this area. The primary reason for this is because this type of ordinance will not fit in or work safely in the majority of the available military weapons.

Explosive projectiles will usually include a high density, sub-caliber penetrator totally enclosed within in a hardened, high-explosive-filled tubular steel body. A nose incendiary within the tubular steel body is ignitable by impact with a target to in turn ignite a second explosive after a suitable time delay. Because all of the penetrator components are housed within a single steel casing, care must be taken to ensure that the incendiary is arranged so that it does not prematurely activate the high-explosive charge. Two charges with a single casing delivered to the target are integral to the existing art.

When impinging a light target, for instance an airplane fuselage, the nose of the traditional projectile will be compacted and the ignition charge will be ignited. Before the second charge in the penetration element explodes the entire projectile will, typically, have pierced to the inside of the target and then after this delay will explode and splinter or fragment the penetration element as well as the casing. Thus, the design typically involves a single ballistic casing encapsulating two explosive charges and a penetrator, rather than a single explosive charge outside the ballistic casing and in its own container followed by a penetrator.

If a sub-caliber penetrator is included, the prior art typically has it enclosed within the tubular steel body of a full-caliber projectile. An outer coating of copper or aluminum is often used so that the hardened heavy metal tube or core of the projectile has a smaller caliber than the weapon, but the coating of the projectile engages with the rifling of the barrel.

Duplex projectiles have been described. A duplex projectile is fired from a gun bore and in one such instance has a tubular projectile and a conically-shaped projectile fastened within the tubular projectile. The conically-shaped projectile is released from the rear of the tubular projectile once the two exit from the bore. While in the barrel, the conically-shaped projectile blocks the release of gas pressure from the cartridge while the round is under pressure from gun propellant gases and also serves as a sub-caliber projectile once it and the tubular projectile leave the muzzle and separate. The tubular projectile or the conically-shaped projectile may be filled with an explosive. Conventional cartridges are not used for this art and the two projectiles are not physically linked together once they leave the barrel.

SUMMARY OF INVENTION

A cartridge for a firearm has a bullet that defines an internal chamber. The chamber has a broader top portion than the lower portion. The bullet further defines a channel passage leading out of the top end of the bullet from the chamber. The bullet contains a body that is an impact-activated explosive. The body is slidably engaged within the channel passage. A shaft is connected to the body and passes down from the body into the lower portion of the chamber. A thrust plate is connected to the shaft end in the chamber. The thrust plate is spring metal and when the cartridge is fired, the thrust plate rises pushing the body so that it extends from the leading end of the bullet. When the thrust plate rises to the second portion of the chamber, it stops at the top of the second portion preventing further outward movement of the body. Upon entering the second portion, the thrust plate springs open to prevent subsequent downward motion of the thrust plate and consequently prevents subsequent retraction of the body during flight and after impact.

Technical Problem

Conventional weapons such as hand guns, rifles, cannons, tanks, and all the way up to the largest artillery on Navel battleships are all engineered and designed to work with a cartridge of a specified length.

Ordinance with a pre-explosive mechanism that protrudes out of the front of the round could be effective for weapons like a single shot bazooka where the length of the cartridge is not a factor either in loading or in safety.

However, a cartridge with a protruding pre-explosive sticking out of the front, is impractical because it would be too long to fit into a magazine and too long to work on the mechanism that loads the round into the chamber. Even if a shorter cartridge were designed with the protruding pre explosive charge that would somehow fit into a conventional weapon system, its ready explosive potential would be dangerous for the soldier that was trying to use the weapon. Ammunition with a protruding pre explosive charge sticking out of the front is like trying to safely hold an armed land mine and hoping nothing touches or bumps into the trigger plunger. This type of cartridge could not be safely stored, transported, loaded into a magazine, or moved from the magazine into the chamber without significant risk of explosion and death to the soldier trying to use it.

This is why the military has few options in regard to a 2-stage pre and primary explosive set up. There is a need for pre and primary ordinance technology whereby these rounds could fit in and work very safely in the majority of conventional weapons systems.

Armor penetrating projectiles are typically large fin-stabilized missiles not made to be fired from firearms, but rather from cannons or other special equipment. There is a need for an explosive bullet for small arms that looks and loads like a standard cartridge.

Small-caliber explosive cartridges, having a caliber less than or equal to 50 caliber, have been described for light armor piercing applications. These designs typically employ a hardened, high-explosive-filled steel penetrator with a copper jacket that interfaces with the rifling in the weapon. There is a need for a bullet with a sub-caliber explosive that does not engage the rifling in a weapon.

Ballistic vests are designed to resist penetration of blunt projectiles, such as are typically used for hand guns. Special purpose handgun ammunition, such as a high-powered, hardened metal bullet is used to overcome ballistic vest and other hard targets. These are essentially bullets manufactured with non-deformable materials that resist expansion upon impact. This feature inherently diminishes the effectiveness of the bullet. There is a need for a standard cartridge with a regular propellant load that has an extensible impact-activated explosive charge.

Solution to Problem

The bullet with a push-out explosive addresses these needs by providing a simple, sub-caliber explosive charge that readies for impact after cartridge discharge and explodes prior to impact of the bulk of the bullet.

The solution is a bullet with a sub-caliber push-out explosive according to the disclosure herein. This solution provides a bullet that will substitute for standard ammunition for any gun, yet have the lethality and penetrating performance of much more powerful bullets.

The disclosed projectile works by having the pre explosive mechanism safely hidden inside of the round. This means that the round is the same length as any other cartridge that is made for the specific weapon. Because the pre explosive mechanism is safely hidden inside, the cartridge can now be safely stored, transported, handled, loaded into the magazine, moved through the magazine, and moved into the chamber for firing.

The disclosed solution enables cartridges of any size to be safely used in any type of conventional type weapon, whether it is semi-automatic, fully automatic, or even the older bolt action weapons. Upon firing the round which is loaded into the barrel, the explosive force that propels the bullet out of the barrel also pushes out and locks in place the protruding pre explosive charge mechanism.

The protruding pre explosive mechanism is of a smaller diameter so it is not touched by the barrel as the round passes through. This technology will give the military and law enforcement many new tools and options to accomplish their missions and come home safe.

This technology can be used even if the bullet does not have a secondary explosive charge. Any conventional weapons system that uses a cartridge and bullet can use this system. Now the military can have a safe pre explosive to use anywhere from the smallest hand gun to the largest tank or battleship gun.

Advantageous Effects of Invention

There can be many different advantageous effects of having a bullet explode a charge against a target immediately before the bulk of the bullet impacts. Such an explosion enhances the lethality of the bullet and enables deeper penetration on hardened targets. For instance, if a terrorist is wearing a bullet-proof vest, the bullet with a push-out explosive will explode immediately against the vest possibly killing or at least disorienting the target prior to actual damage from impact of the main body of the bullet.

In addition, an explosion against the body of a ballistically-protected target will help to create a penetrating hole through any such protective gear worn by the target. The explosion from the bullet with a push-out explosive will blast through, soften or erode the target protective gear so that the bulk of the bullet has more effective and deeper penetration than might otherwise be the case.

Because the explosive charge is not pushed out until after the cartridge is fired, the cartridge will fit and work in any weapon or gun mechanism in a fashion equivalent to the usual cartridge used for the weapon or gun mechanism. When the bullet with a push-out explosive is fired and it travels through the barrel, the explosive charge does not in any way interfere with the rifling or bullet spin because it is narrower than the diameter inside the barrel. In this sense, it is a sub-caliber explosive charge.

After the explosion upon impact with the target, the bulk of the bullet impacts the target. Target resistance pushing against the bulk of the bullet causes the bullet to mushroom and expand, doing more target damage.

In today's War on Terror and regional conflicts, the bullet with a push-out explosive is a new, useful tool that will keep America's soldiers safe and help to keep America strong. It will give police and special weapons and tactical (SWAT) team members added tools to overcome terrorists employing ballistic protection.

Whether for a soft target or a hard target, an explosive bullet is one that can improve lethality and effectiveness in disabling a hostile, or cause them to surrender without a fight. Combined in a standard cartridge, the bullet with a push-out explosive offers ease of use for myriad potential military and police Special Forces engagements. A policeman or soldier needs only to insert a clip with these cartridges in any shootout with terrorists, enemy combatants or criminals and his firepower and effectiveness has increased manifold.

No longer will an enemy's use of a bullet proof vest or concealment within a hardened enclosure offer protection. Bullet proof cars and military trucks that previously protected enemy combatants or suicide drivers can now be stopped in their tracks or easily disabled. The terrorist or enemy combatant can be stopped with fewer bullets. Conventional bullets, made primarily from lead, often become deformed and less effective after striking hard targets, especially when fired at handgun velocities. These are not easily overcome and penetrated with normal ammunition, which spreads upon impact. When it spreads, the larger impact area prevents penetration.

The bullet with a push-out explosive may be provided with a regular propellant load, which means that cartridge use will not change the practiced behavior of the weapon with similar non-explosive bullets.

The disclosed solution will help to keep America safe and free from all of the terror and military turmoil in this world.

BRIEF DESCRIPTION OF DRAWINGS

The drawings illustrate preferred embodiments of the bullet with a push-out explosive according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the bullet with a push-out explosive. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
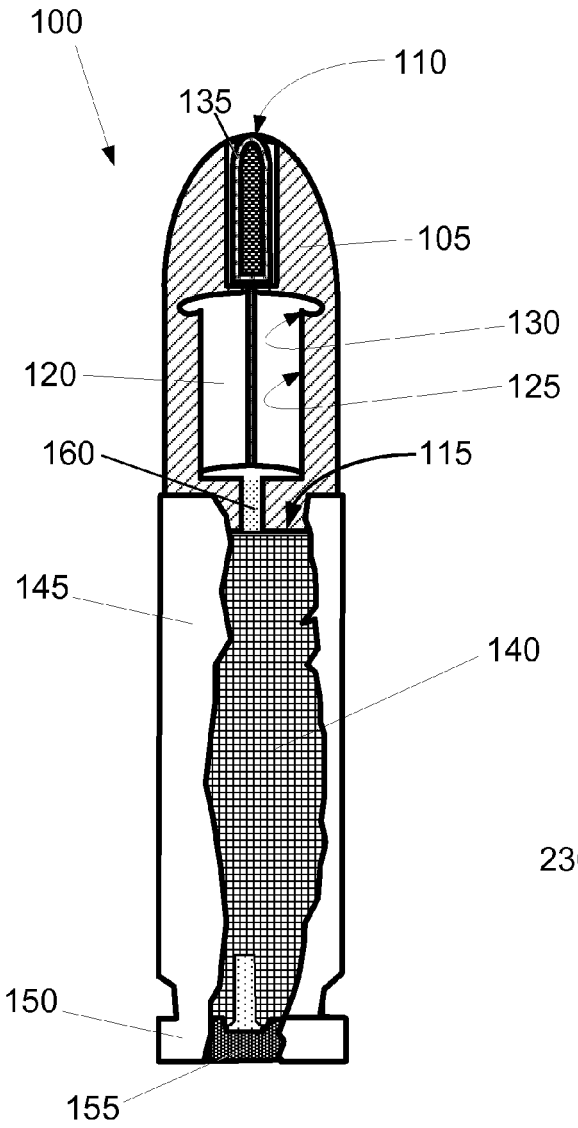
FIG. 1 is a sectional elevation view of a ready-to-fire cartridge having a bullet with a push-out explosive.

The bullet with a push-out explosive is a projectile that is fired from a weapon that is either a handgun or cannon. A cartridge (100) that may be used to hold the bullet (105) is shown in FIG. 1. As a projectile, the bullet with a push-out explosive may be embodied as a small-caliber projectile within a traditional cartridge for a firearm or it may be embodied in a large-caliber projectile and cartridge, such as an artillery shell fired from a cannon. An alternative embodiment of the bullet, shown in FIG. 6, includes a second explosive charge (605) within the bullet (105) that explodes after impact and after the initial explosion from an impact-activated explosive (320). For either embodiment, the bullet configuration is the same for small and large caliber applications. The added secondary explosive charge (605) may be included in a large projectile or small caliber cartridge.

FIG. 1 is a sectional elevation view of a cartridge (100) that is ready-to-fire. It includes a bullet (105), as described herein, namely the bullet with a push-out explosive. The cartridge (100) is for a firearm in that it is intended to be fired from a weapon. As with typical cartridges for guns, there is included in the cartridge a propellant (140), bullet case (145) that holds the bullet (105), a rim (150) at the firing end of the cartridge, and a primer (155) that once struck by a firing pin of the weapon ignites the propellant (140) and sends the bullet (105) on its way. A sealant (160), such as wax, paper or a wadding material, may be used to close the bottom end of the bullet to prevent propellant (140) from prematurely entering the chamber (120). Alternatively, the thrust plate (315) may be structured to close off the propellant-end (115).

Figure 2:
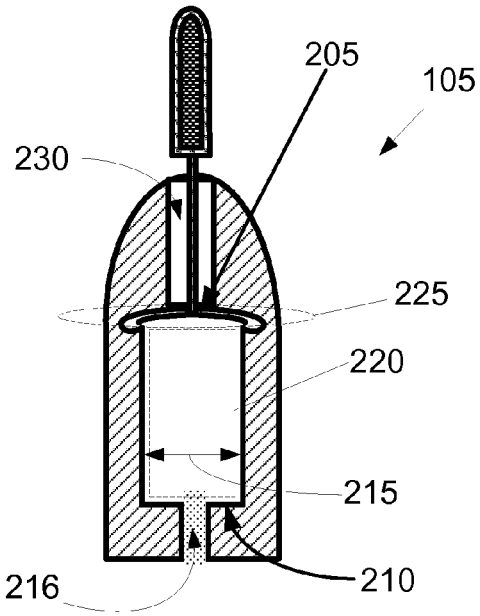
FIG. 2 is a sectional elevation view of the bullet with a push-out explosive after it is fired from a cartridge.
Figure 5:
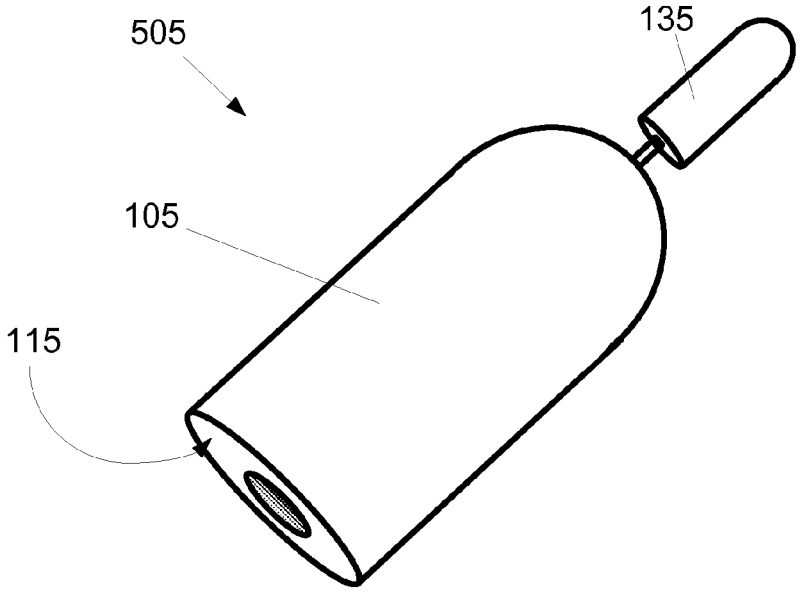
FIG. 5 is a perspective view of a projectile after it is discharged and before impact at a target.

FIG. 5 is a perspective of a projectile (505) showing the bullet (105) with the body (135) extended and before impact at a target. This is exactly the same internal structure and components as the bullet (105) as illustrated in FIG. 2. Projectile (505) could be discharged from either a cartridge or cannon. Thus, the explanation that follows applies to a bullet within a cartridge and a bullet that is a projectile fired from a cannon.

The bullet (105) has an external end (110) and a propellant-end (115) within the cartridge (100). The bullet (105) defines a chamber (120) within its confines. The chamber (120) includes a chamber top-end (205), as shown in FIG. 2, a chamber bottom-end (210), and a chamber width (215), which are designated so that they can be referenced to better describe the structure of the bullet (105). The chamber top-end (205) is situated nearest the external end (110) of the bullet (105) and the chamber bottom-end (210) situated nearest the propellant-end (115). The terms vertical or horizontal are used herein with reference to the orientation shown in FIG. 1.

The chamber (120) has a first portion (220), the first portion (220) comprising a wall (125) extending vertically between the chamber bottom-end (210) and a point (130) below the chamber top-end (205). The first portion (220) is preferably a cylindrical lower part of the chamber (120) with a fixed diameter.

Figure 3:
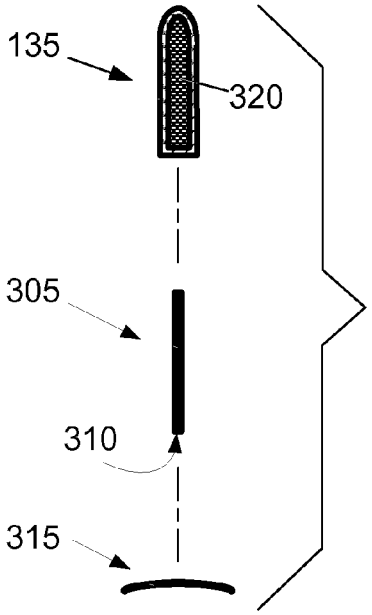
FIG. 3 is an exploded view of the body containing an impact-activated explosive, a shaft and a thrust plate.

The chamber (120) has a second portion (225), the second portion (225) enlarging the chamber width (215) and extending from the chamber top-end (205) to the point (130). When the first portion (220) of the chamber (120) is a cylinder, the second portion (225) sits at the top of the first portion (220) like a hat. The second portion (225) has a larger diameter than the first portion (220). This expanded width of the second portion (225) enables room for the thrust plate (315) to spring into it and once it has sprung into the second portion (225), the thrust plate (315), shown in FIG. 3, cannot thereafter move downward into the first portion (220). This structural arrangement prevents downward movement of the thrust plate (315) and consequently the body (135). Any such downward movement of the body (135) would retract the body (135) from its extended position jutting out from the external end (110) or top of the bullet (105) and preclude its effectiveness in penetrating the target.

Figure 4:
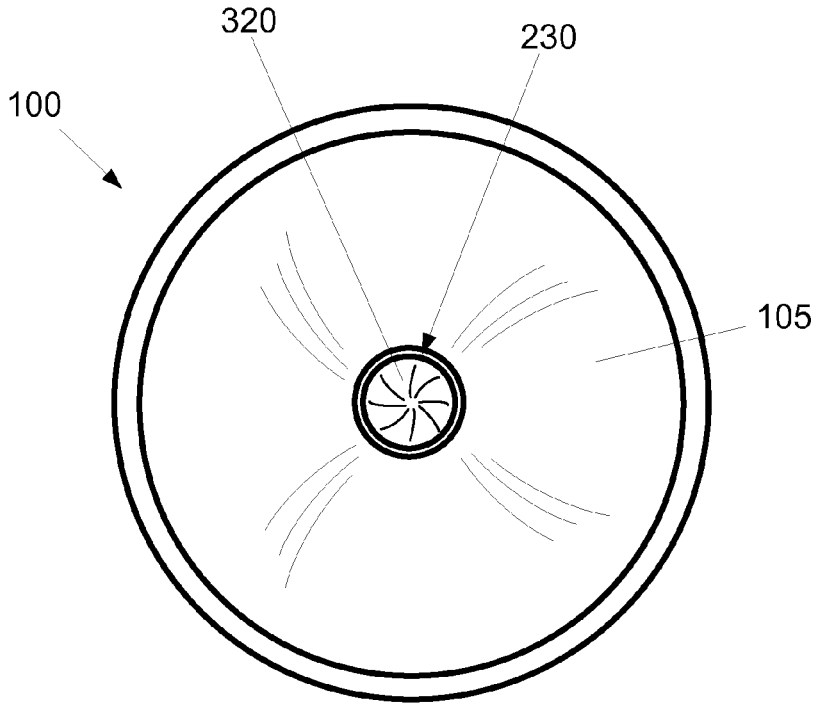
FIG. 4 is a top view of a cartridge with the bullet containing the impact-activated explosive.

The bullet (105) further defines a channel passage (230), illustrated in FIG. 4, which leads out of the bullet (105) through the external end. The channel passage includes one or more passages to permit slidable movement of the shaft (305) and the body (135) within the bullet (105). A second channel passage (216) extends from the propellant-end (115) of the bullet (105) to the chamber (120) below the thrust plate (315).

In manufacture, the channel passage (230), or other passages as may be present for the body design, may be covered to prevent unwanted contamination. Potential covers are wax, minimally-sticking tape, or other sealant that similarly presents only almost no resistance to the slidable exit of the body (135) from within the bullet (105).

The cartridge (100) includes a body (135) slidably engaged within the channel passage (230). FIG. 4 is a top view of a cartridge (100) with a bullet with a push-out explosive showing channel passages having a shape to permit the push-out explosive to extend out of the end of the bullet (105) when the cartridge (100) is fired. The impact-activated explosive (320) ignites upon target impact and the bullet mass or bulk behind the explosion follows to aid in penetration of the target.

The body (135) is a functional part of the bullet with a push-out explosive in that it functions to deliver an impact-activated explosive (320) to the target prior to the impact of the bulk of the bullet in order to have the mass of the bullet more easily penetrate a bullet resistant target. The body (135) may include a hardened material or a frangible material forming a container around the impact-activated explosive (320). A typical hardened material for such container is a tube of a heavy, hard metal, such as tungsten, a tungsten alloy, or depleted uranium. Preferably, the impact-activated explosive (320) is ignited by the heat and pressure created as a natural result of impact.

The impact-activated explosive (320) is defined herein to include: a chemical compound that blows up upon impact, such as firmly packed thermite-type composition; an incendiary, which is a chemical compound that causes fire upon impact; or a pyrophoric, which is a chemical compound that ignites spontaneously upon impact and exposure to air. In alternative embodiments, a combination of these chemical compounds may be used, such as for example when a stable incendiary is used, an explosive ignition charge may be supplied to ensure ignition of the incendiary upon target impact. Since thermite is self oxidizing, the reaction does not require external support of oxygen. When initiated, the exothermic reaction generates extreme heat, high gas pressure, and a molten mass of metal and oxides.

There are numerous and well known compositions that are impact-activated explosives. Examples are iron sulfide and many reactive metals including uranium, when powdered or thinly sliced. For example, where M stands for a metal element and sub x and sub y stand for the number of atoms in the element immediately preceding the sub x or sub y, and O stands for oxygen, an exemplary impact-activated explosive (320) comprises a mix of M.sub.x O.sub.y and aluminum, or M.sub.xO.sub.y and magnesium. A pyrophoric is typically a metal compound deficient in metal and rich in oxygen. An incendiary is usually a metal that is fully reacted with oxygen.

The cartridge (100) includes a shaft (305) connected to the body (135) and passing down from the body (135) to a shaft end-point (310) within the chamber (120). The shaft (305) provides the mechanical connection to move the body (135) when the cartridge (100) is fired. The shaft (305) moves the body (135) to a position past the external end (110) of the bullet (105) so that the explosion does not also destroy the bullet (105).

The cartridge (100) includes the thrust plate (315) connected to the shaft end-point (310). The thrust plate (315) is made of spring metal, preferably spring steel, and is configured to spring open when it rises to the second portion (225) and thereby inhibit downward motion of the thrust plate (315). When the propellant (140) in the cartridge explodes, it simultaneously fires the bullet (105) and drives the thrust plate (315) towards the external end (110) of the bullet (105) setting the body (135) into a deployed position extending from the external end (110) of the bullet (105). The hole connecting the propellant-end (115) of the bullet to the chamber (120), which is shown in FIG. 1 filled with a sealant (160), may be sized according to the propellant charge in the bullet and the malleability of the bullet. A soft lead bullet, for example, will need a smaller diameter hole than a jacketed coated lead bullet or a steel bullet. The hole size is determined so that the body (135) slides in the channel passage (230) and the thrust plate (315) does not push through the chamber top-end (205) when the cartridge (100) is fired.

Figure 6:
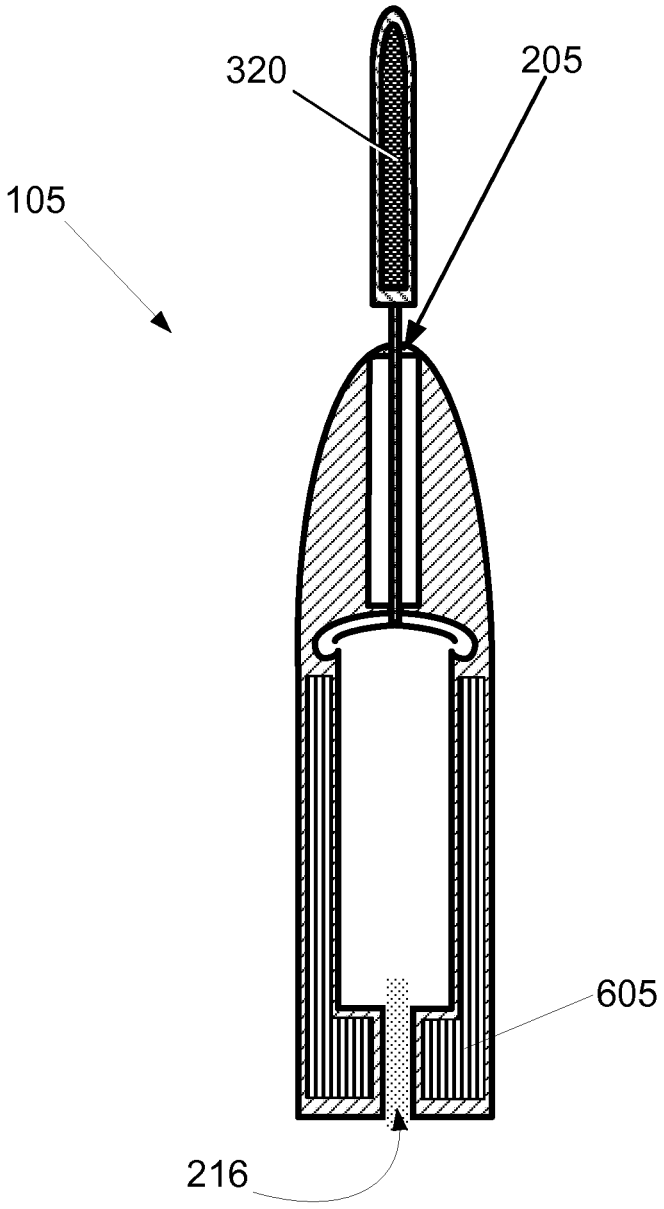
FIG. 6 is a sectional view of the bullet with a push-out explosive having a post-impact explosive charge within the bullet.

FIG. 6 is a sectional view of the bullet with a push-out explosive having a post-impact explosive charge within the bullet. The post-impact explosive charge is also referred to as a second explosive charge (605). The second explosive charge (605) may be in several parts or it may be a singular, uniform mass. Preferably, the second explosive charge (605) has an annular cross-section of a singular, uniform mass so that it may surround the second channel passage (216).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the firearms industry.

What is claimed is:

1. A cartridge for a firearm, the cartridge comprising:

a bullet, the bullet comprising:

an external-end; and a propellant-end within the cartridge, the bullet defining a chamber, the chamber comprising:

a chamber top-end, a chamber bottom-end, and a chamber width, the chamber top-end situated nearest the external end of the bullet and the chamber bottom-end situated nearest the propellant-end;

a first portion, the first portion comprising a wall extending vertically between the chamber bottom-end and a point below the chamber top-end; and a second portion, the second portion enlarging the chamber width and extending from the chamber top-end to the point;

the bullet further defining a channel passage leading out through the external end;

a body comprising an impact-activated explosive, said body slidably engaged within the channel passage;

a shaft connected to the body and passing down from the body to a shaft end-point within the chamber; and a thrust plate connected to the shaft end-point, the thrust plate comprised of a spring metal and configured to spring open when it rises to the second portion and thereby inhibit downward motion of the thrust plate.

2. A projectile comprising:

a bullet having a tapered external-end and a propellant-end;

the bullet defining a chamber within, the chamber comprising:

a chamber top-end, a chamber bottom-end, and a chamber width, the chamber top-end situated nearest the tapered external-end of the bullet and the chamber bottom-end situated nearest the propellant-end;

a first portion, the first portion comprising a wall extending vertically between the chamber bottom-end and a point below the chamber top-end; and a second portion, the second portion enlarging the chamber width and extending from the chamber top-end to the point;

the bullet further defining a channel passage leading out through the tapered external-end;

a body comprising an impact-activated explosive, said body slidably engaged within the channel passage;

a shaft connected to the body and passing down from the body to a shaft end-point within the chamber; and a thrust plate connected to the shaft end-point, the thrust plate comprised of a spring metal and configured to spring open when it rises to the second portion and thereby inhibit downward motion of the thrust plate.

3. The projectile of claim 2, further comprising a post-impact explosive charge within the bullet.

* * * * *